US006574985B2

(12) United States Patent
Fiore, Jr.

(10) Patent No.: US 6,574,985 B2
(45) **Date of Patent: *Jun. 10, 2003**

(54) BEVERAGE BOTTLE CONTAINER

(76) Inventor: Joseph F. Fiore, Jr., 711 Aspen La., Lebanon, PA (US) 17042

( * ) Notice: Subject to any disclaimer, the term of this patent is extended or adjusted under 35 U.S.C. 154(b) by 0 days.

This patent is subject to a terminal disclaimer.

(21) Appl. No.: 10/123,651

(22) Filed: Apr. 16, 2002

(65) Prior Publication Data

US 2002/0112502 A1 Aug. 22, 2002

Related U.S. Application Data

(63) Continuation-in-part of application No. 09/642,409, filed on Aug. 21, 2000, now Pat. No. 6,385,992.

(51) Int. Cl.[7] ..... F17C 13/00
(52) U.S. Cl. ..... 62/457.9; 62/536; 62/457.4
(58) Field of Search ..... 62/457.9, 457.4, 62/536

(56) References Cited

U.S. PATENT DOCUMENTS 3,998,072 A 12/1976 Shaw
4,281,520 A 8/1981 Norwood
4,338,795 A 7/1982 House, Jr.
4,413,481 A 11/1983 Thomas
4,580,412 A 4/1986 Wells
4,628,705 A 12/1986 Nave
4,961,324 A 10/1990 Allan
5,188,877 A 2/1993 Magaro
5,313,807 A 5/1994 Owen
5,325,988 A 7/1994 Ekern
5,406,808 A 4/1995 Babb et al.
5,555,746 A 9/1996 Thompson
6,385,992 B1 * 5/2002 Flore, Jr. ..... 62/457.9

* cited by examiner

*Primary Examiner*—William C. Doerrler
*Assistant Examiner*—Mark Shulman
(74) *Attorney, Agent, or Firm*—Fay, Sharpe, Fagan, Minnich & McKee, LLP

(57) ABSTRACT

A beverage bottle container includes a pair of rigid, double-walled mating container portions having inner surfaces for engagement with a beverage bottle. Each of the container portions includes a bottom surface, hinge means, and a top surface which defines a bottle neck receiving passageway. The inner surfaces include bottle engagements means in the form of internal projections suitable to engage and otherwise secure beverage bottles of varying shape and size.

24 Claims, 18 Drawing Sheets

BEVERAGE BOTTLE CONTAINER

CROSS-REFERENCE TO RELATED PATENT APPLICATION

The present application is a continuation-in-part of co-pending U.S. application Ser. No. 09/642,409, filed on Aug. 21, 2000, now U.S. Pat. No. 6,385,992.

BACKGROUND OF THE INVENTION

The present invention relates to beverage bottle containers and, more particularly, to portable beverage bottle containers for transporting, protecting, thermally insulating and/or cooling beverage bottles contained therein.

In response to an increasingly active society, a wide variety of refreshment beverages, including sodas, sports drinks, and water, are now available in portable glass and plastic bottles ranging in size from 12 ounces to 1 liter or more. These single, portable bottles are often transported to sporting events, outdoor events, and indoor activities.

The single beverage bottles are often made of glass or thin-walled plastic, therefore having little or no impact resistance. In addition, it is often desirable to maintain such a beverage bottle as cold as possible in order to obtain optimum taste and refreshment. Accordingly, a need exists for a convenient portable beverage bottle container, which adequately protects and maintains the temperature of single beverage bottles of varying size.

The present invention contemplates a new and improved beverage bottle container, which overcomes the above-referenced problems and others.

SUMMARY OF THE INVENTION

In accordance with one aspect of the present invention, a beverage bottle container includes a pair of rigid, mating container portions having inner surfaces for engagement with a beverage bottle. Each of the container portions includes a bottom surface, hinge means, a top surface, which defines an aperture through which a neck of the beverage bottle protrudes. Bottle engagement means project from the inner surface of at least one of the container portions.

In accordance with a more limited aspect of the present invention, the bottle engagement means includes at least one conical projection.

In accordance with a more limited aspect of the present invention, the bottle engagements means includes a pair of spherical projections disposed opposite one another on respective inner surfaces of the container portions.

In accordance with another aspect of the present invention, a beverage bottle container includes a pair of rigid, double-walled mating container portions, which include inner surfaces for engagement with a beverage bottle. Each of the container portions include a bottom surface having a first bottom support member extending along a first direction perpendicular to the longitudinal axis and a second bottom support member extending along a second direction perpendicular to the first direction. Hinge means are disposed above and adjacent to the bottom surface. Each of the container portions includes a top surface, which defines a bottle neck receiving passageway and a pair of strap posts extending along the first direction perpendicular to the longitudinal axis. Carrying and fastening means are operatively connected to the strap posts for holding the container portions in a closed position.

In accordance with a more limited aspect of the present invention, the inner surface of at least one of the container portions includes beverage bottle engagement means.

In accordance with another aspect of the present invention, a bottle carrier includes a pair of double-walled mating portions joined to form a substantially cylindrical, thermally insulated inner chamber. The bottle carrier includes a support base, which extends from the bottom of the inner chamber for supporting the carrier in an upright position. Hinge means are molded into one of the support base and a side portion of at least one of the mating portions. The bottle carrier includes a latching assembly having a latch and receiving slot and a carrying handle, which is operatively connected to a top surface of at least one of the mating portions.

One advantage of the present invention resides in a beverage bottle container having a lightweight and rigid construction.

Another advantage of the present invention resides in internal projection elements for engagement with beverage bottles of varying shapes and sizes.

Another advantage of the present invention resides in a portable beverage bottle container, which allows the beverage to be poured without removing the bottle from the container.

Yet another advantage of the present invention resides in the provision of a clamshell beverage bottle container having molded-in hinges.

Still other benefits and advantages of the present invention will become apparent to those skilled in the art upon a reading and understanding of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
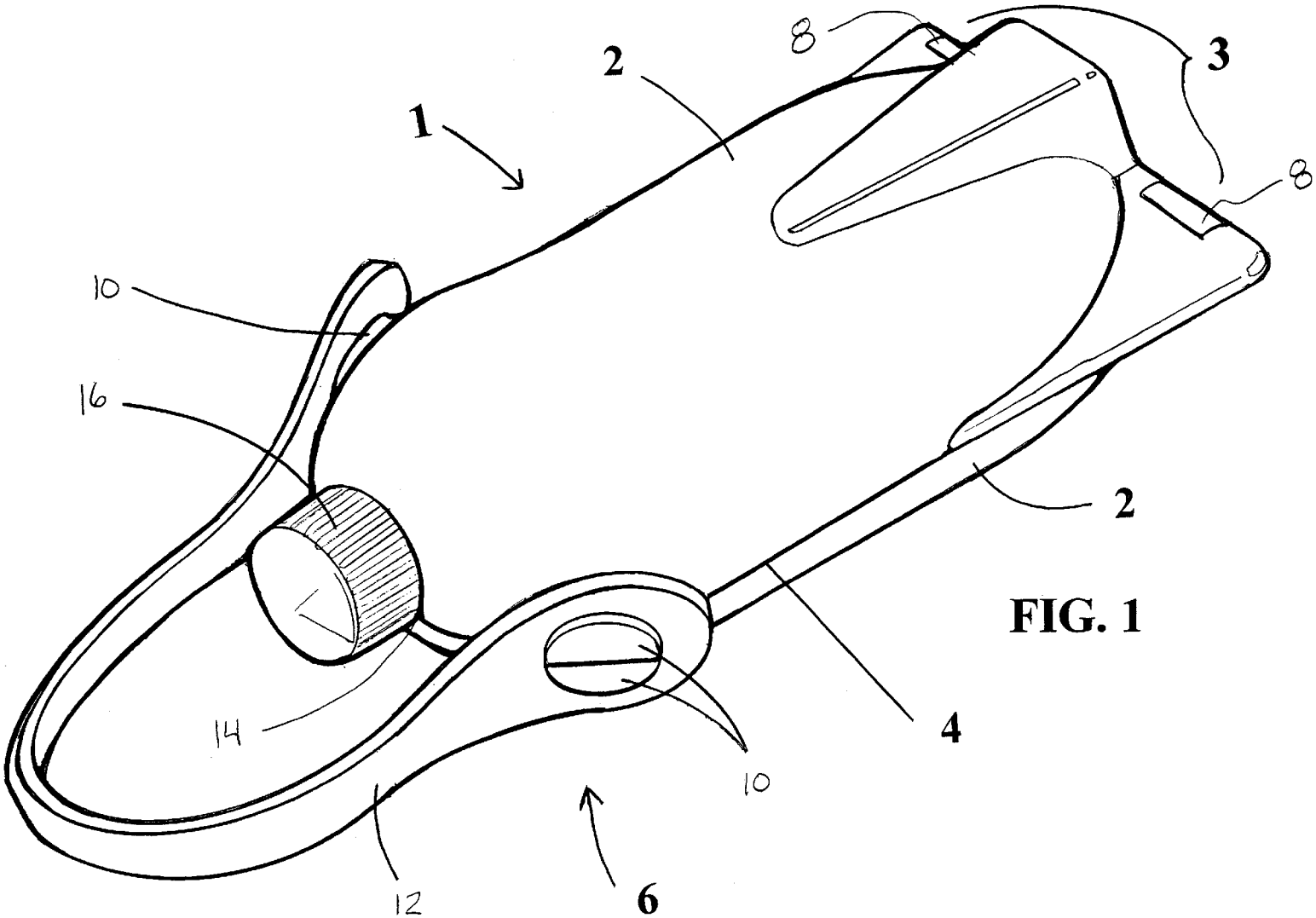
FIG. 1 is a perspective view of a beverage bottle container having a carry handle attached thereto and a beverage bottle contained therein in accordance with of the present invention.

Referring now to the drawings wherein the showings are made for purposes of illustrating preferred embodiments of the invention only and not for limiting same, FIG. 1 shows a beverage bottle container 1 in accordance with one preferred embodiment of the present invention. The beverage bottle container 1 includes a pair of rigid, double-walled container portions 2, which join along a centerline 4. The container portions are made of a lightweight, rigid material, preferably polyethylene. However, other suitable materials are also contemplated. In one embodiment, the container portions 2 include a pair of container halves, that is, portions of equal size. Alternatively, the container portions are unequal in size.

Referring to FIGS. 1–8, each of the container portions 2 includes a bottom surface 3 and a top surface 6. In one embodiment, the two container portions are hinged adjacent a bottom surface 3 by hinge means 8. More particularly, the hinge means 8 include a pair of molded-in hinges and corresponding cooperative mating slots, which allow the container to be opened while standing in an upright position. In one embodiment, the top surface 6 includes a pair of projections or strap posts 10 extending therefrom. The container portions are latched or otherwise fastened together by a detachable carrying means 12, such as a strap or handle, which releasably engages the pair of support posts 10.

Figure 2:
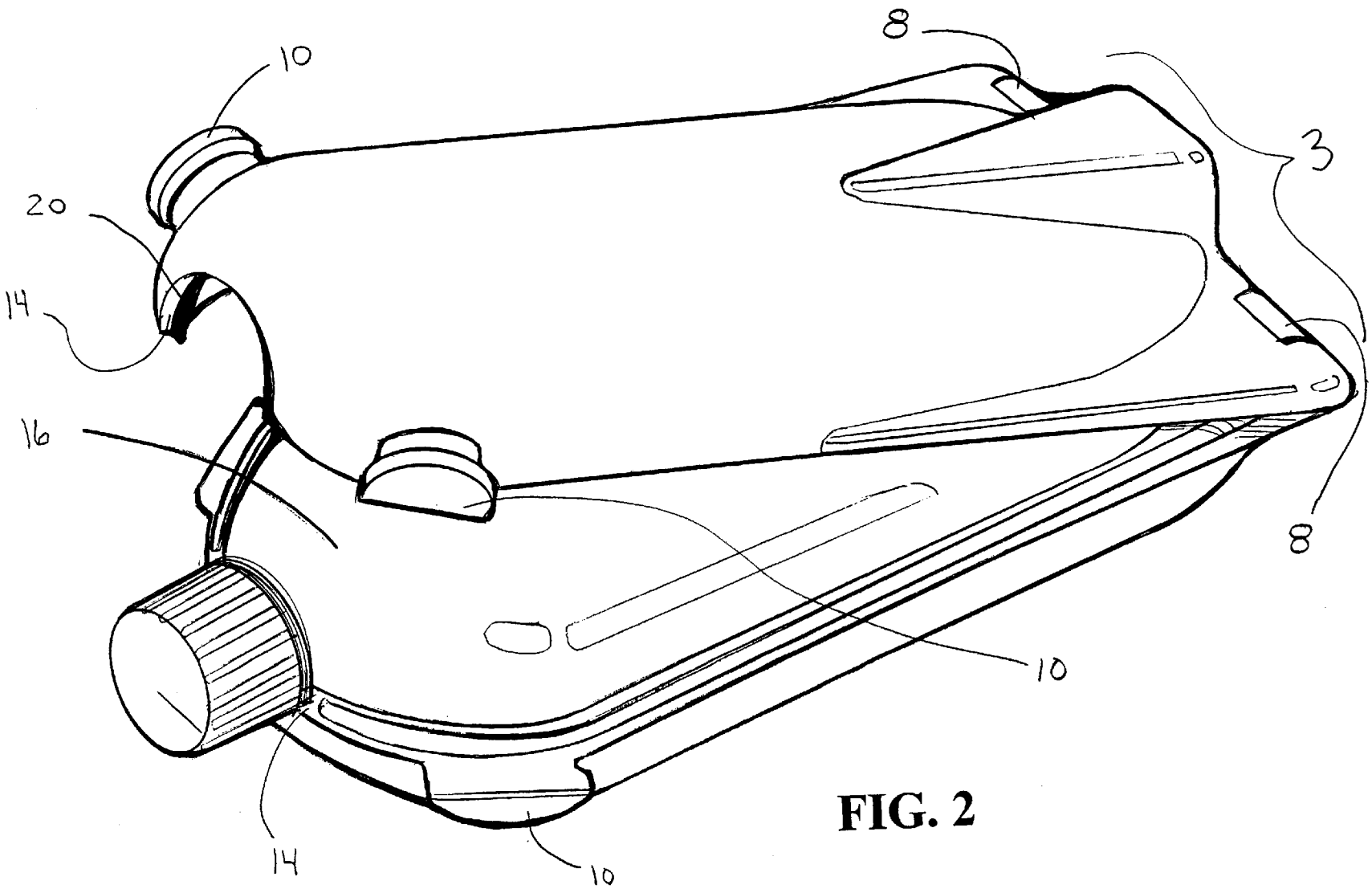
FIG. 2 is a perspective view of the beverage bottle container in a partially opened configuration with a beverage bottle contained therein in accordance with the present invention.
Figure 3:
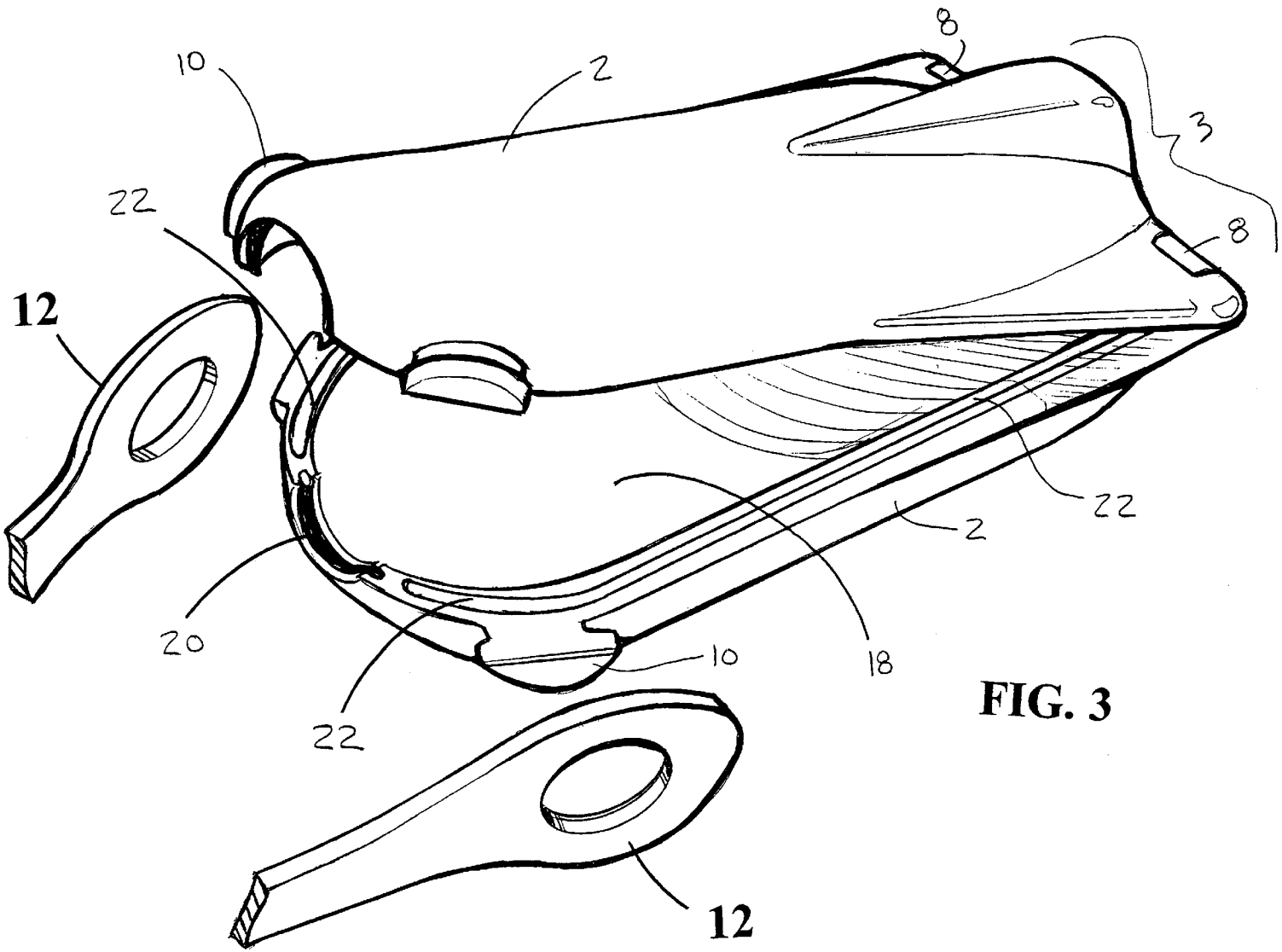
FIG. 3 is a perspective view of the beverage bottle container in a partially opened configuration along with a partial view of the carry handle in accordance with the present invention.
Figure 4:
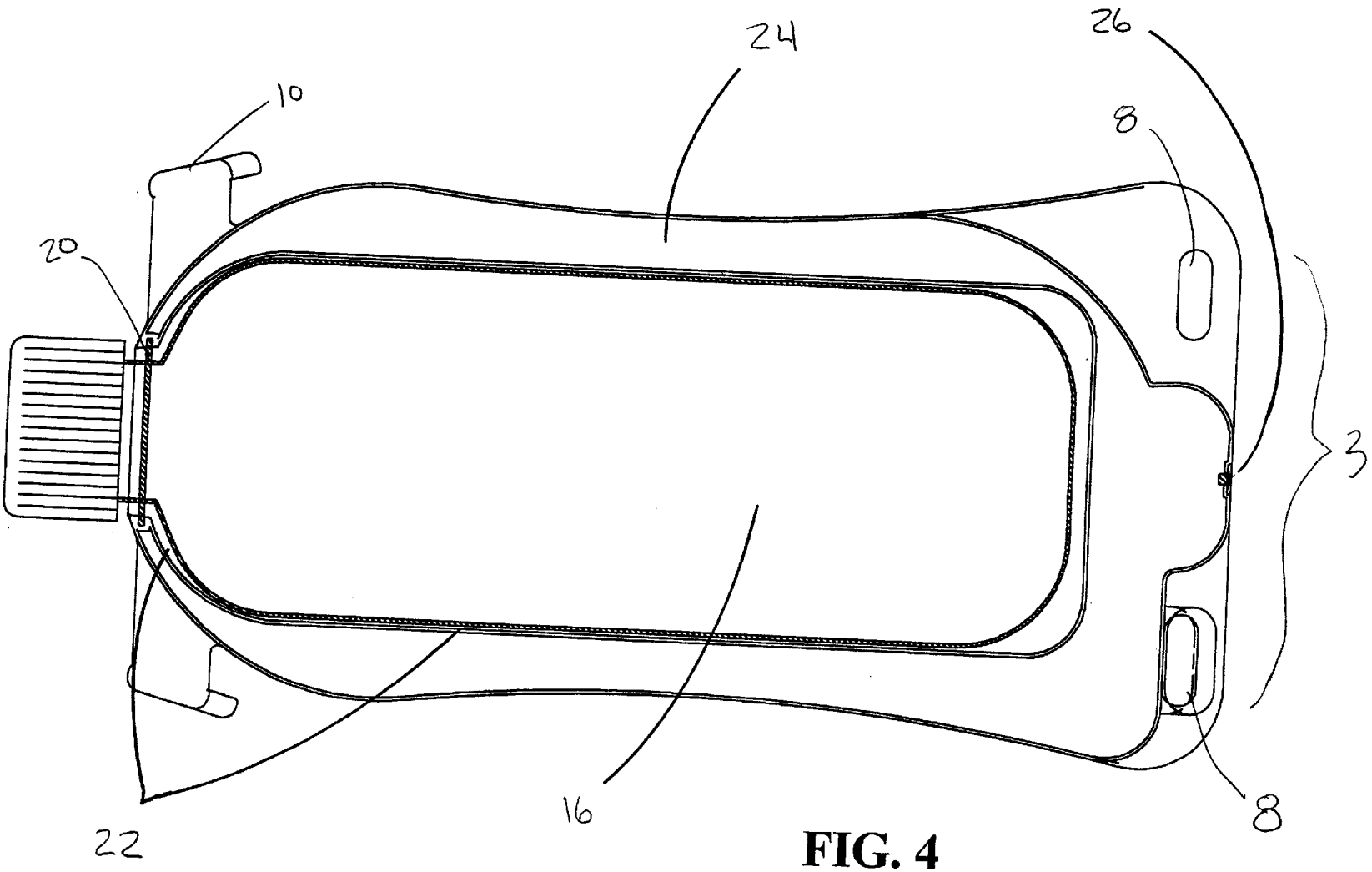
FIG. 4 is a cross-sectional view of the beverage bottle container with a beverage bottle contained therein in accordance with the present invention.
Figure 5:
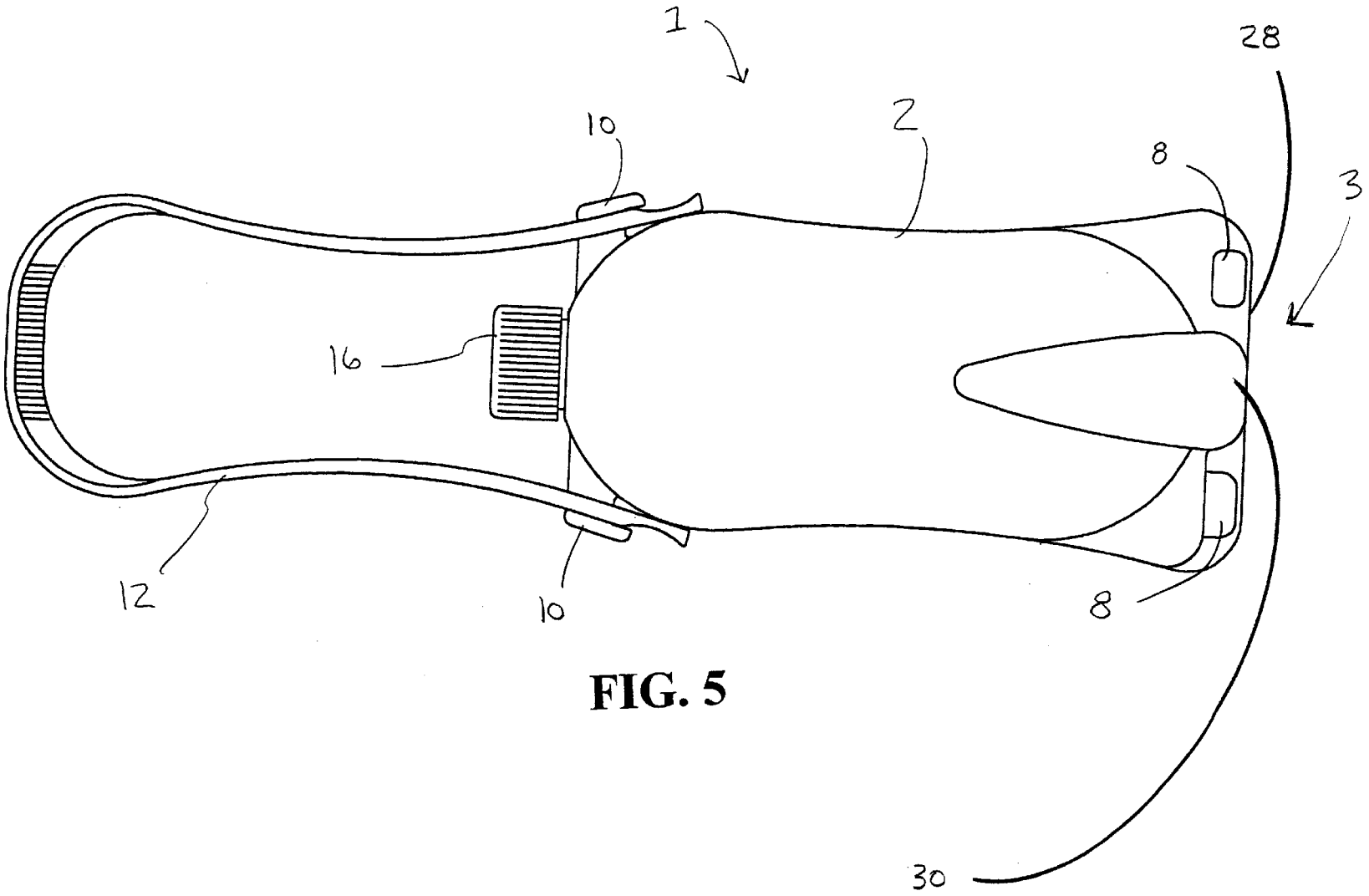
FIG. 5 is a side plan view of the beverage bottle container in accordance with the present invention.
Figure 6:
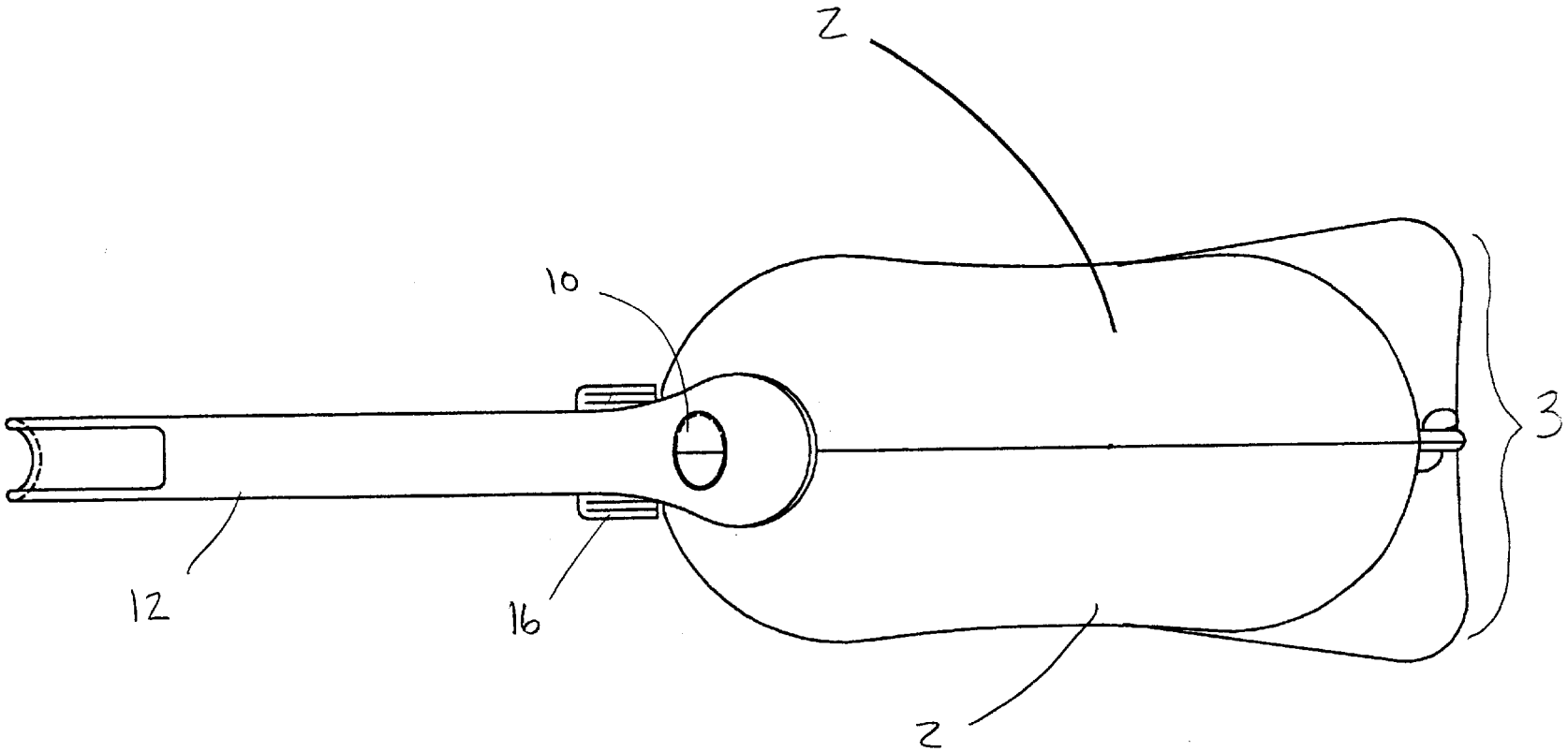
FIG. 6 is a side plan view of the beverage bottle container of FIG. 5 rotated by 90°.
Figure 7:
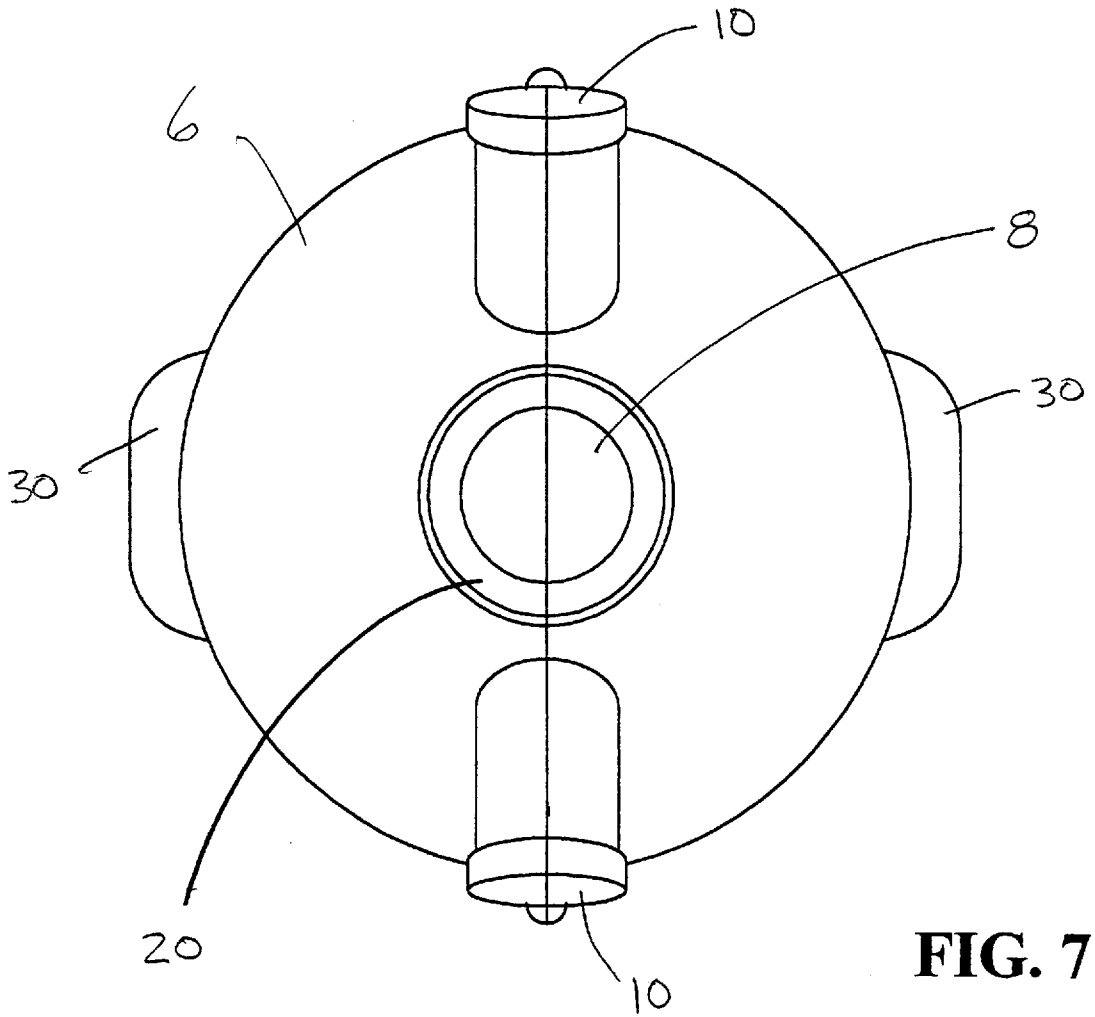
FIG. 7 is a top plan view of the beverage bottle container in accordance with the present invention.

The container portions 2, when fastened together, define a bottle neck receiving passageway 14 through which a portion of a beverage bottle 16 contained therein extends beyond the top surface 6 of the container, thereby providing ready access to the beverage bottle while the beverage bottle remains encapsulated within the container. As shown in FIGS. 2 and 3, the beverage bottle container opens along the hinged bottom surface 3, providing access to a beverage bottle contained within a bottle recess or cavity. More particularly, each of the container portions includes an inner surface 18, preferably a substantially cylindrical inner surface, which, when the container is latched or otherwise fastened together, forms the bottle recess adaptive to contain beverage bottles of various shapes and sizes. However, it is to be appreciated that at least one of the inner surfaces may be substantially square, oval, flat, or the like.

The beverage bottle container includes sealing means around the perimeter of each container half Preferably, the sealing means include a first seal 20, such as a two-piece gasket or o-ring, which is disposed around the perimeter of the bottle neck receiving passageway. The first seal provides thermal insulation and accommodates beverage bottles of varying size. The sealing means further includes a second seal 22, such as a tongue and groove sealing edge, a gasket, or a seal within a groove, around the perimeter of one or both of the inner surfaces 18.

Figure 8:
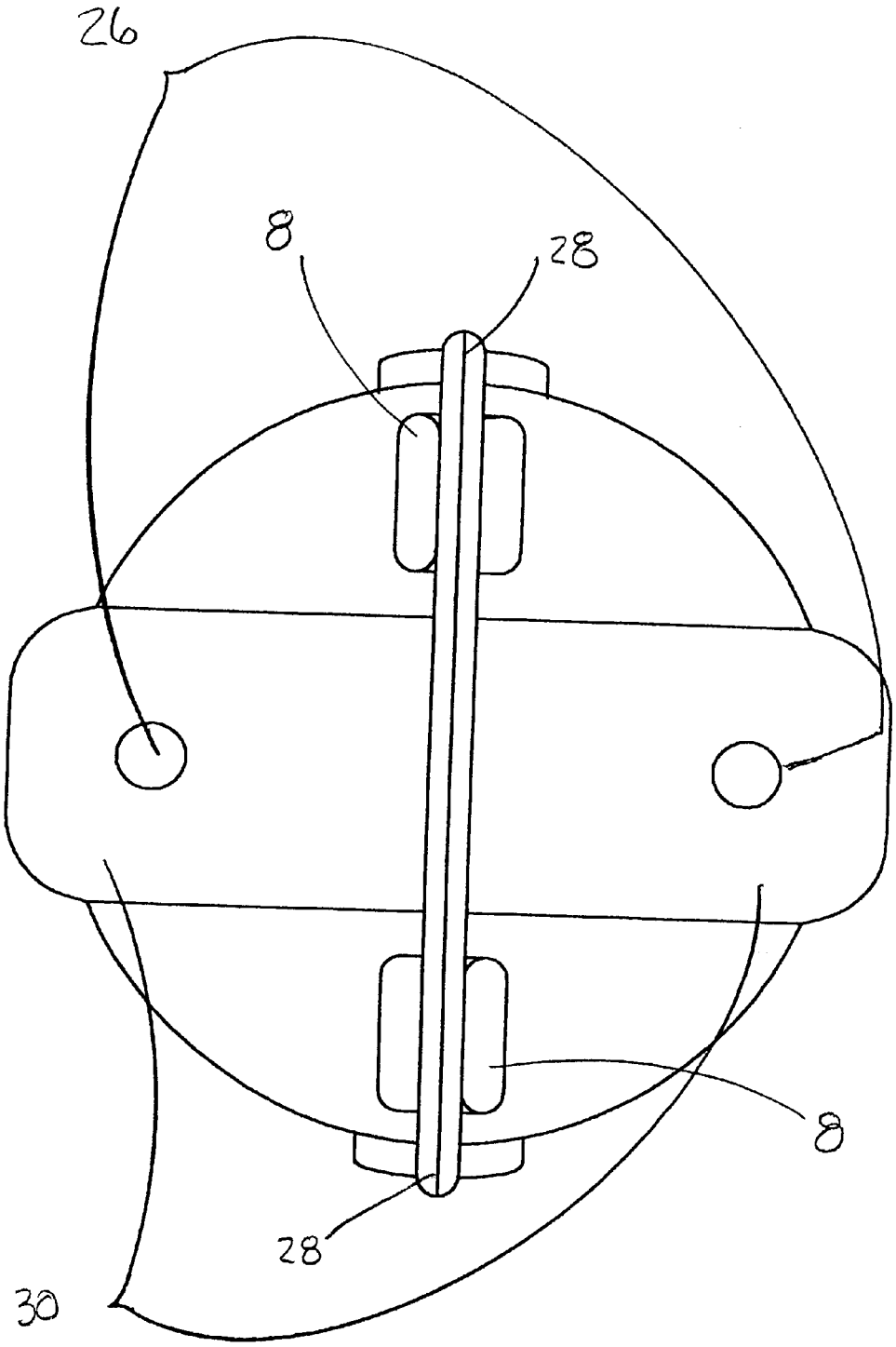
FIG. 8 is a bottom plan view of the beverage bottle container in accordance with the present invention.

In one embodiment, each of the container portions 2 are double-walled, such that they define an internal cavity 24 (illustrated in FIG. 4) for receiving one of a number of thermal insulation materials and coolants, including, but not limited to, foams and freezable coolants. As shown in FIG. 8, the bottom surface 3 defines one or more plugged or capped apertures 26 through which the internal cavity 24 may be filled with insulation or coolant. In one embodiment, the bottom surface 3 includes a first bottom support member or support ridge 28, which extends along a first direction perpendicular to a longitudinal axis of the bottle container, and a second bottom support member or foot support 30, which extends in a second direction perpendicular to the first direction. However, as is described more fully below, other bottom surface configurations such as flat, round bottom surfaces are also contemplated.

Figure 9:
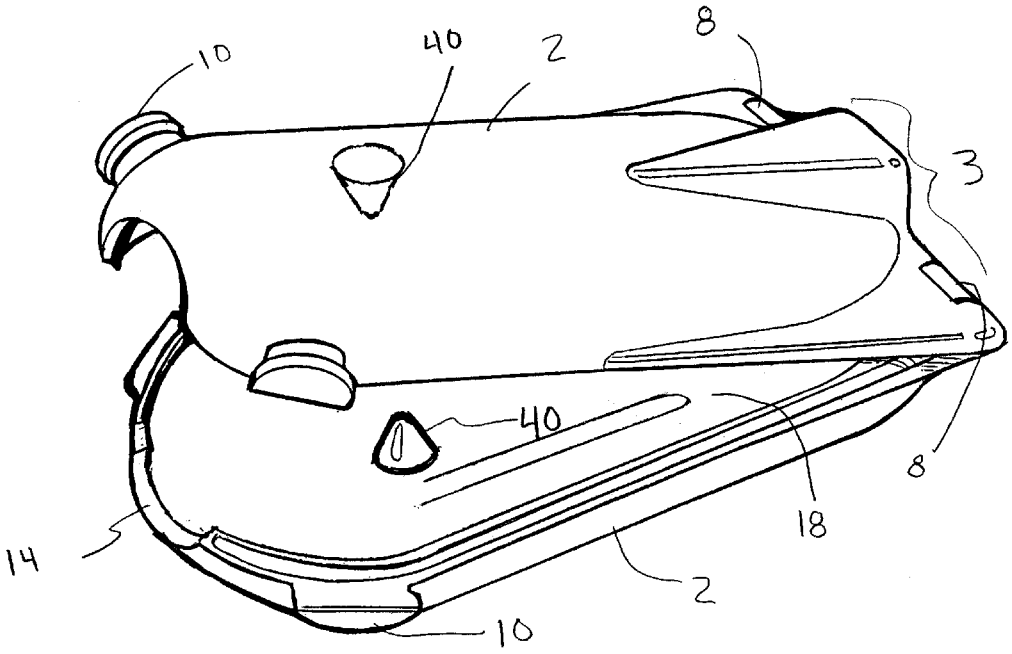
FIG. 9 is a perspective view of the beverage bottle container in a partially opened configuration showing a pair of internal conical projections in accordance with one embodiment of the present invention.
Figure 10:
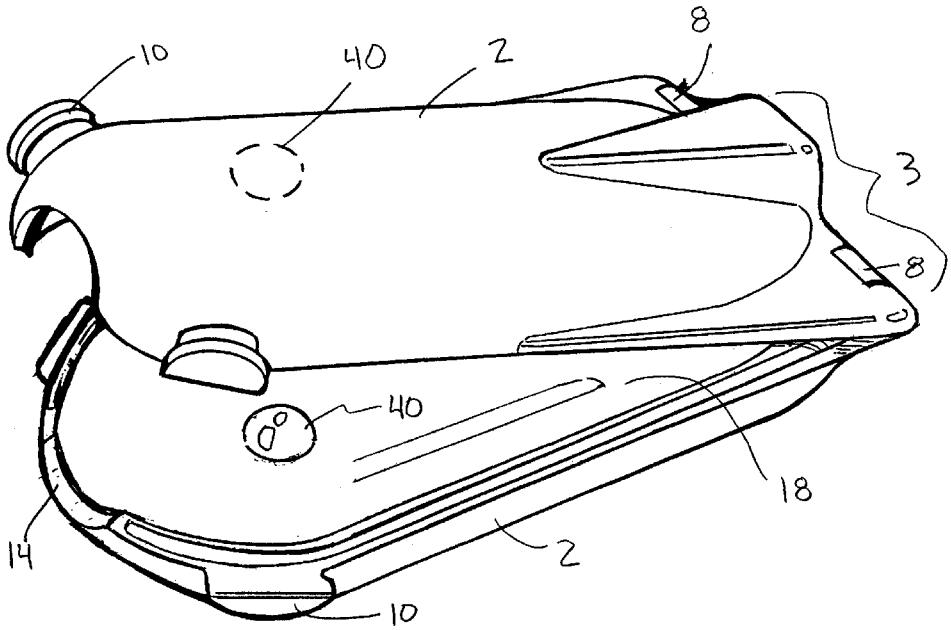
FIG. 10 is a perspective view of the beverage bottle container in a partially opened configuration showing a pair of internal spherical projections in accordance with another embodiment of the present invention.

With reference now to FIGS. 9–12, where like components are designated by like reference numerals, in one embodiment, at least one of the inner surfaces 18 of the container portions 2 include beverage bottle engagement means. More particularly, the beverage bottle engagement means include one or more internal projections 40, which extend from each inner surface 18 inward toward a beverage bottle contained within the container. The internal projections may include any one of a plurality of geometries suitable for engaging or otherwise securing beverage bottles of varying size and shape within the container. For example, FIG. 9 shows a pair of conical projections 40 projecting from the respective inner surfaces 18 of the first and second container portions 2. In another embodiment, illustrated in FIG. 10, the internal projections include a pair of spherical projections 40 extending from the respective inner surfaces 18 of the container portions 2 for engagement with a beverage bottle.

Figure 11:
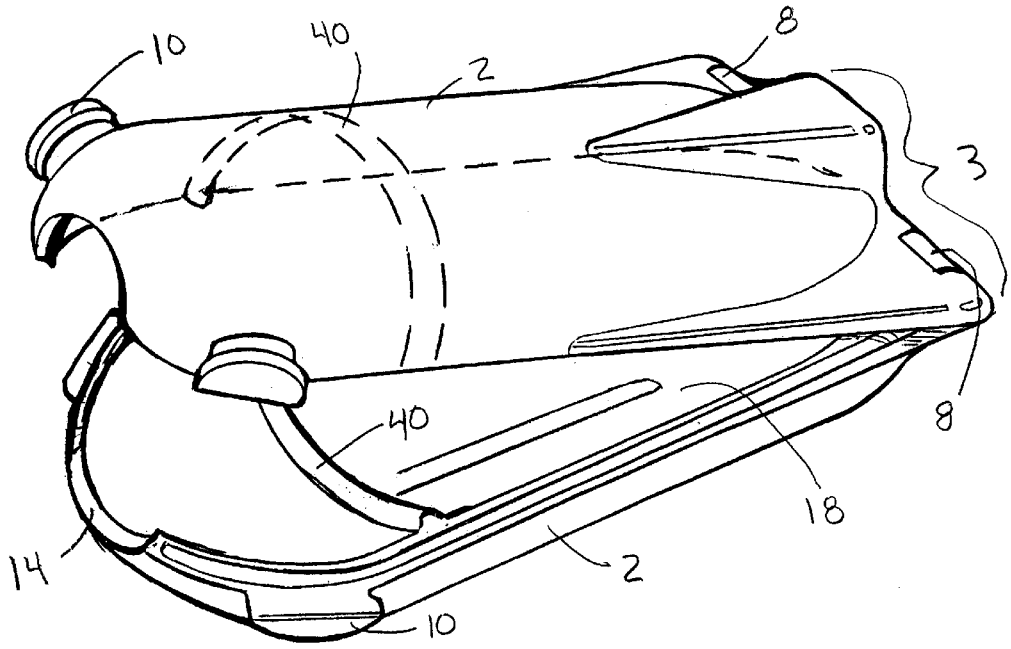
FIG. 11 is a perspective view of the beverage bottle container in a partially opened configuration showing a pair of internal annular projections in accordance with another embodiment of the present invention.
Figure 12:
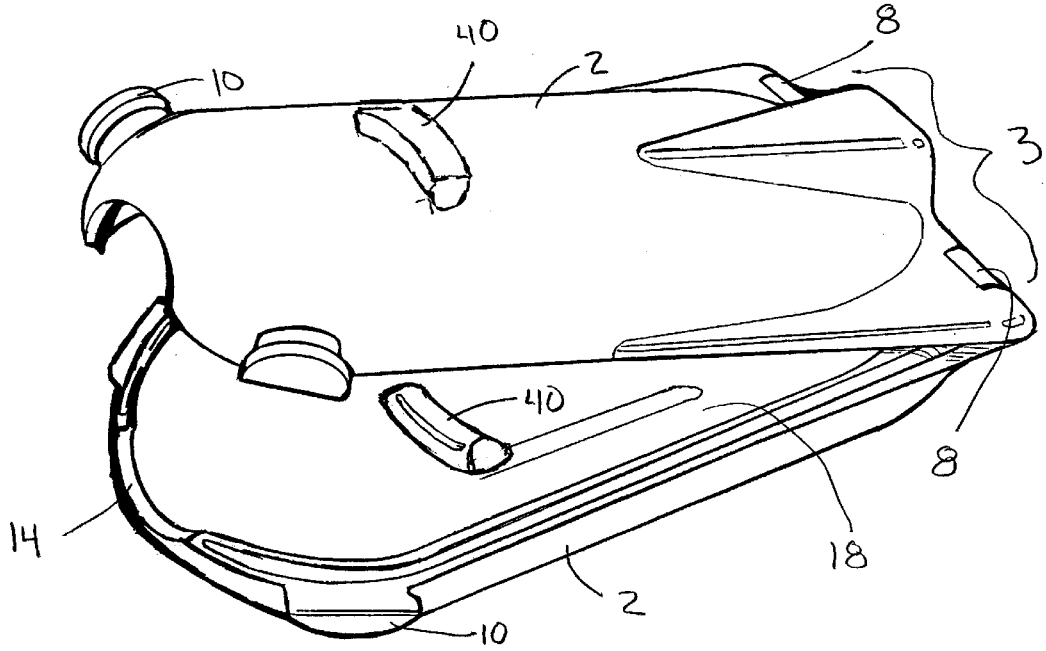
FIG. 12 is a perspective view of the beverage bottle container in a partially opened configuration showing a pair of annular projection segments in accordance with another embodiment of the present invention.

FIG. 11 shows another embodiment in which the bottle engagement means include a pair of annular or arcuate projections 40. In one embodiment, the annular projections 40 are continuous. Alternately, the annular projections may be interrupted or segmented. Alternately, as illustrated in FIG. 12, the internal projections 40 may be of any irregular shape suitable for engaging and securing beverage bottles of varying size and shape. Depending upon the particular application, the bottle engagement means may be integrally molded of the same rigid material as the internal surfaces of the container portions. Artisans will appreciate that this embodiment is well-suited for engaging beverage bottles of flexible construction, such as plastics. Alternately, the bottle engagement means may be formed of a more pliable material, such as foams, rubbers, and the like, which is well-suited for engaging beverage bottles of more rigid construction, such as glass bottles.

Figure 13:
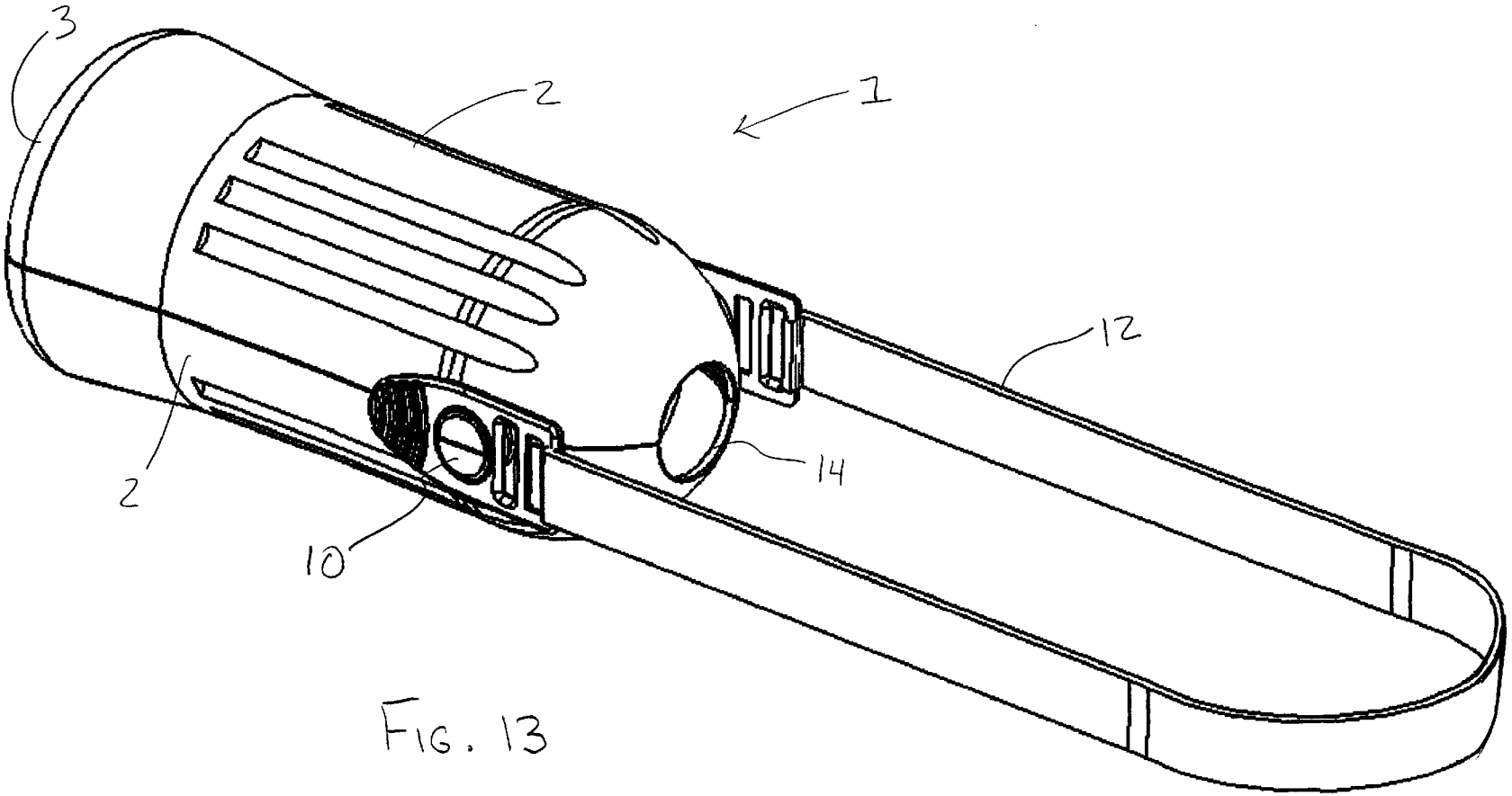
FIG. 13 is a perspective view of the beverage bottle container in accordance with another embodiment of the present invention.
Figure 14:
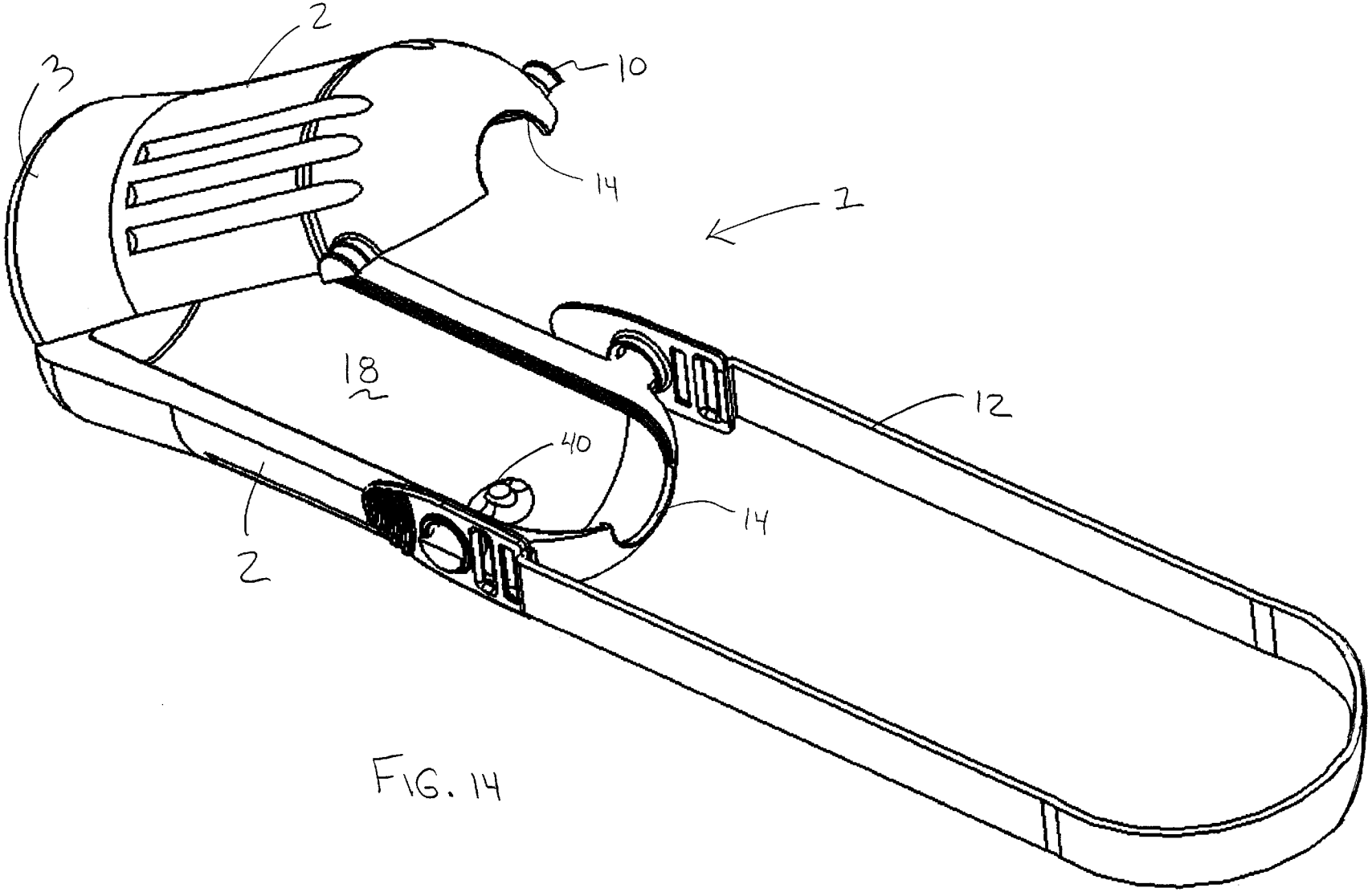
FIG. 14 is a perspective view of the beverage bottle container shown FIG. 13 in a partially opened configuration.
Figure 15:
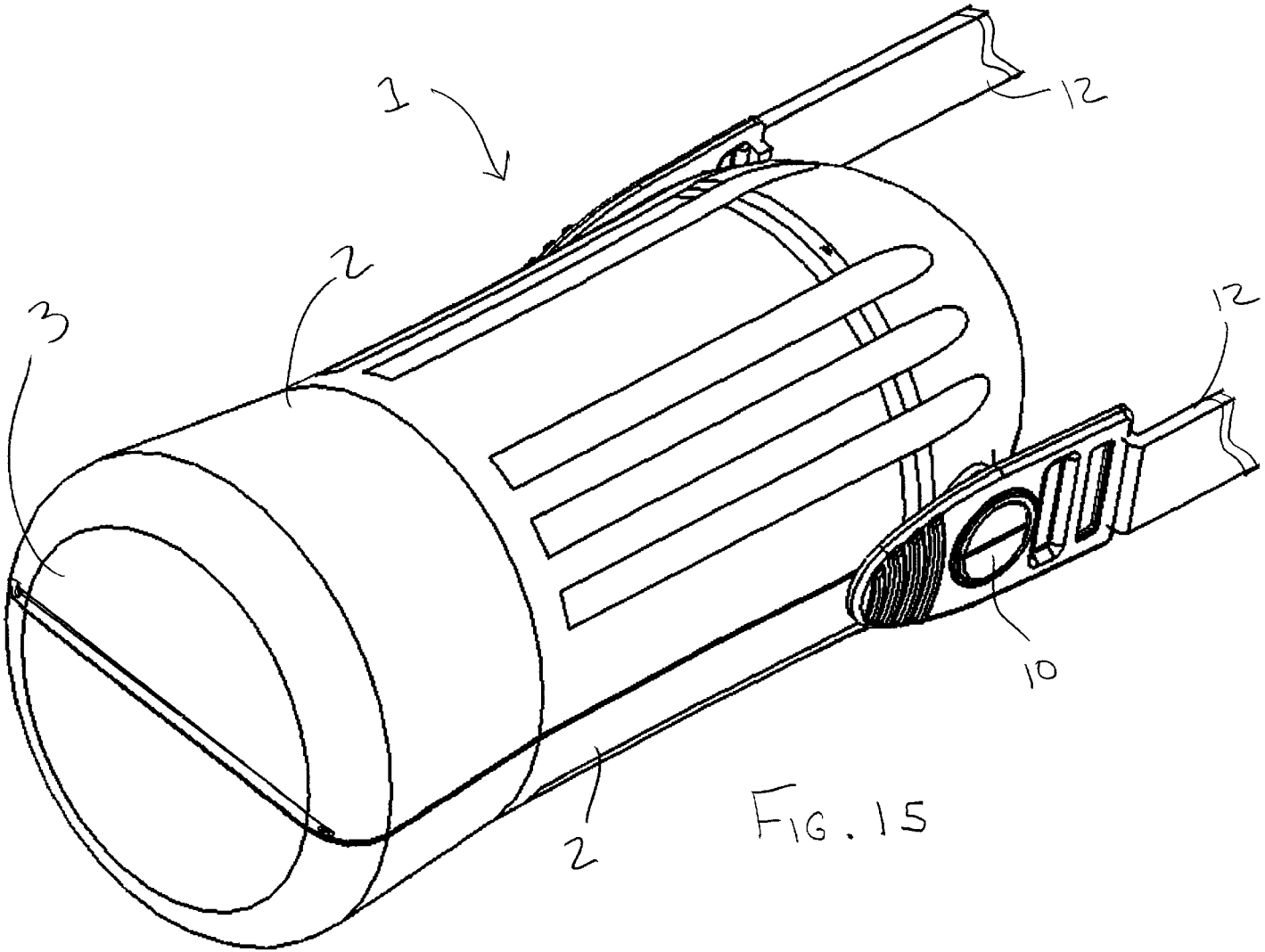
FIG. 15 is an enlarged perspective view of the bottom portion of the beverage bottle container shown in FIG. 13.
Figure 16:
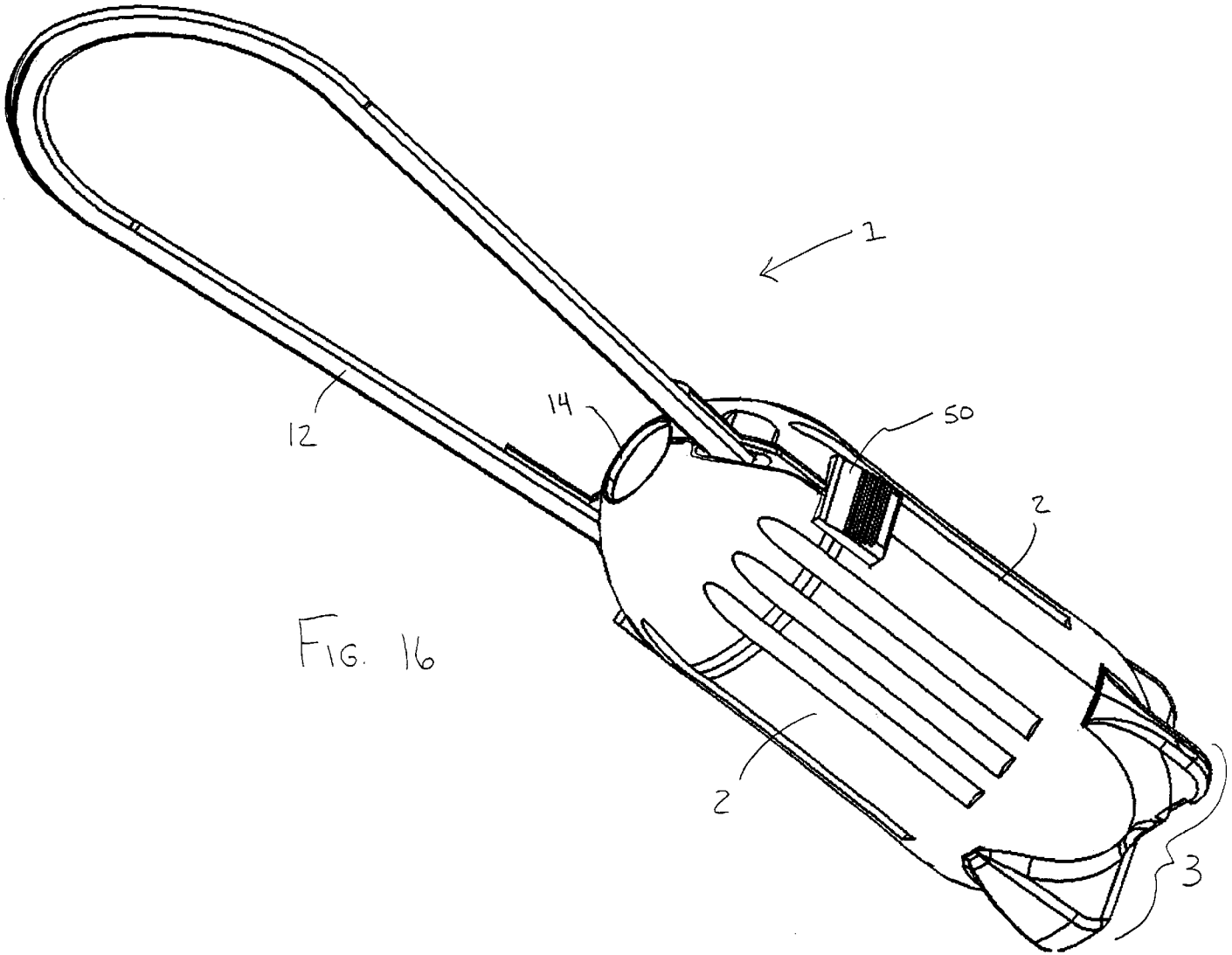
FIG. 16 is perspective view on a beverage bottle container having an alternate fastening means in accordance with another aspect of the present invention.
Figure 17:
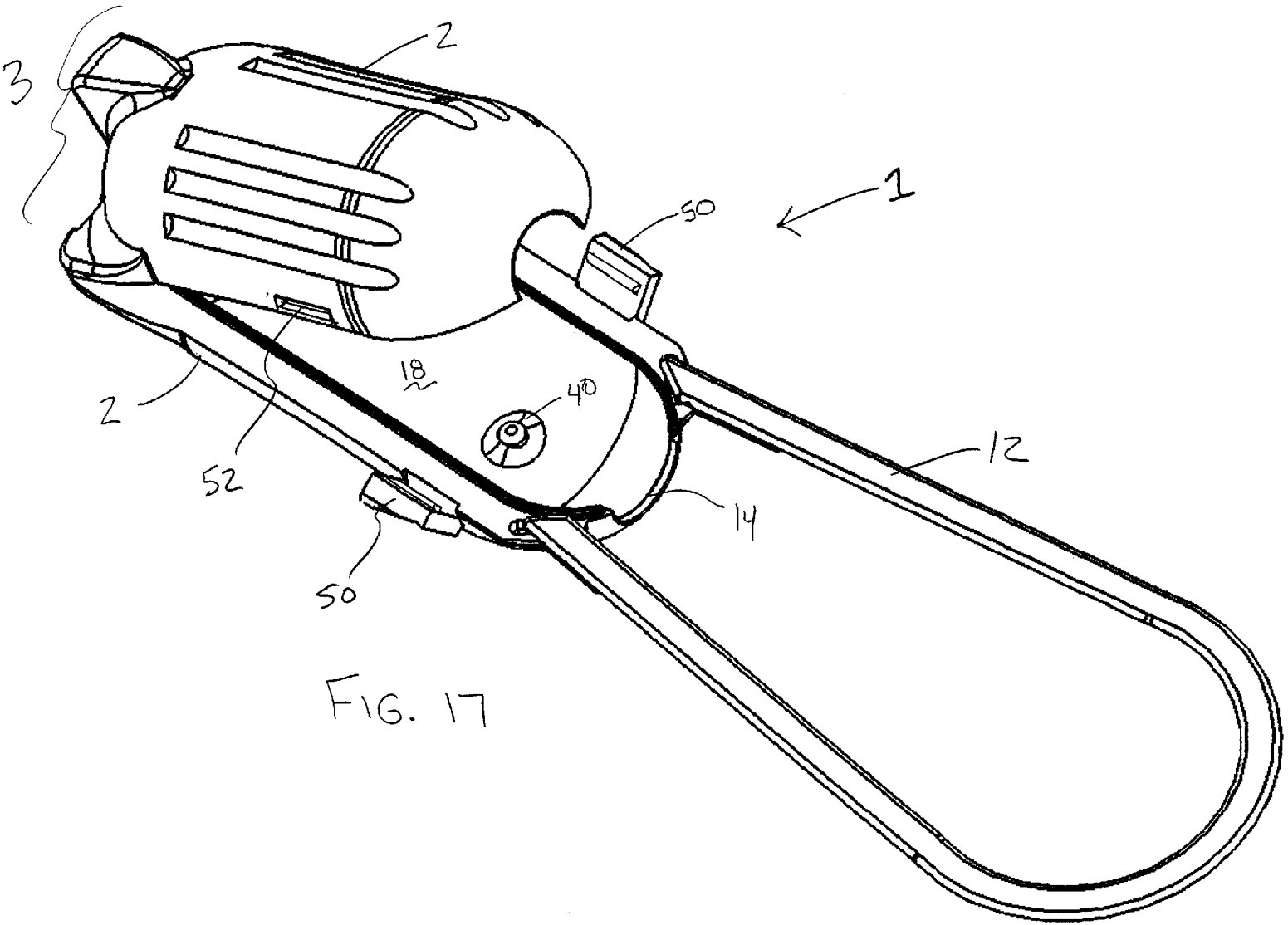
FIG. 17 is a perspective view of the beverage bottle container shown in FIG. 16 in a partially opened configuration.
Figure 18:
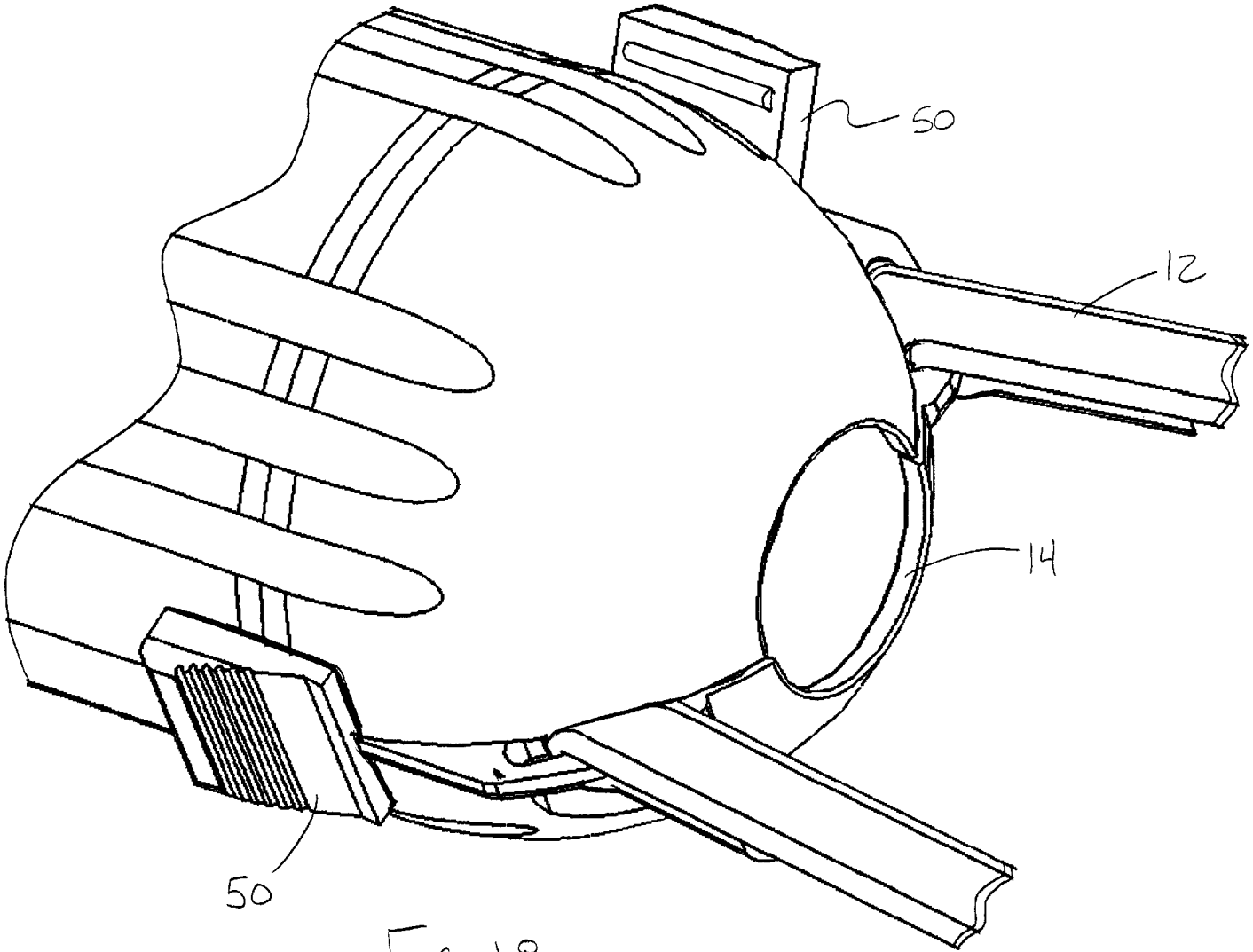
FIG. 18 is an enlarged perspective view of a portion of the beverage bottle container shown in FIG. 16.

As is described above, the present invention is amenable to a variety of external container geometries. For example, as shown in FIGS. 13–15, the bottom surface 3 of the container may be flat and circular or square, including bottom hinges. However, other suitable bottom surfaces are contemplated within the scope of the present invention.

Figure 19:
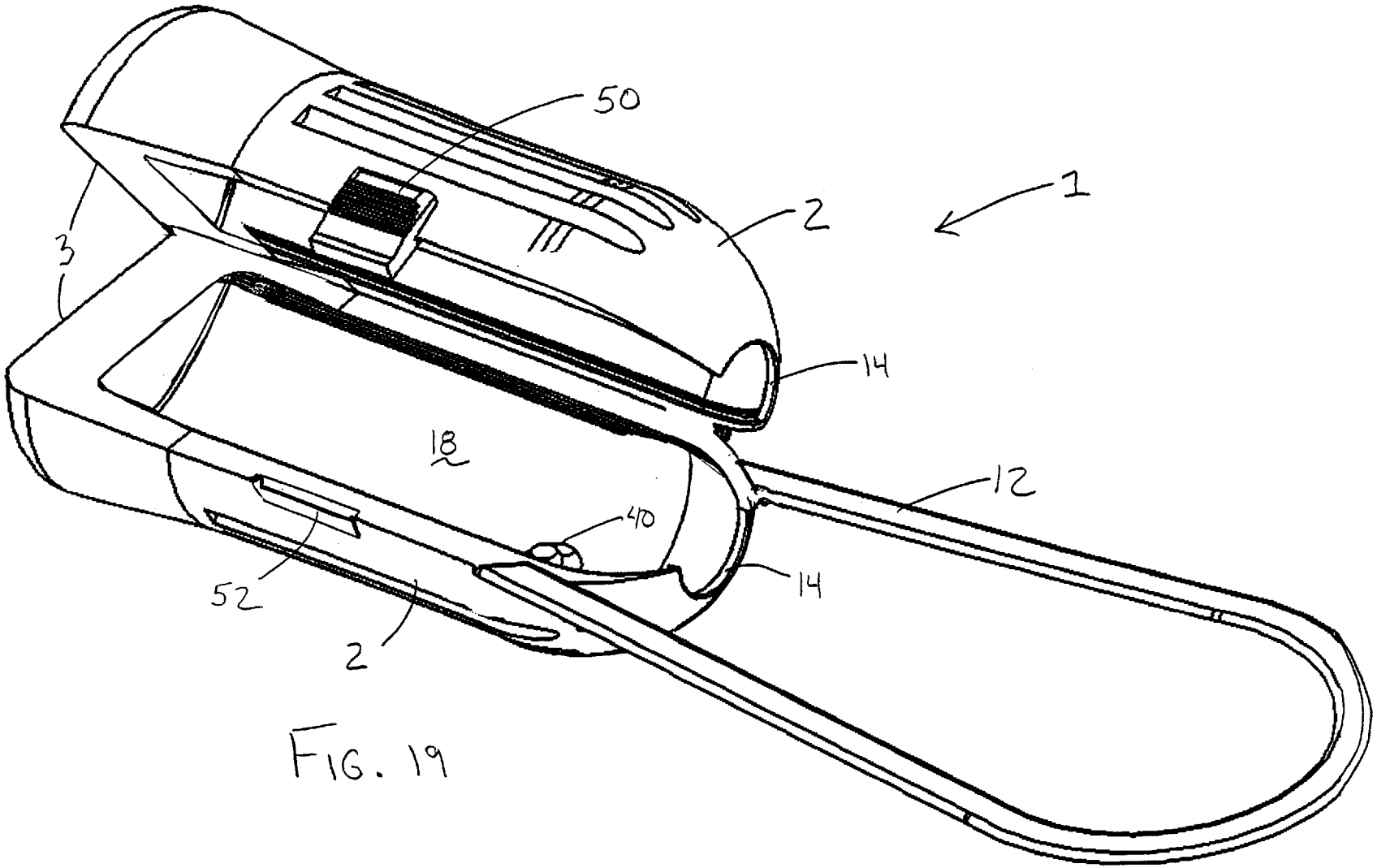
FIG. 19 is a perspective view of a beverage bottle container having a hinged side in accordance with another embodiment of the present invention.
Figure 20:
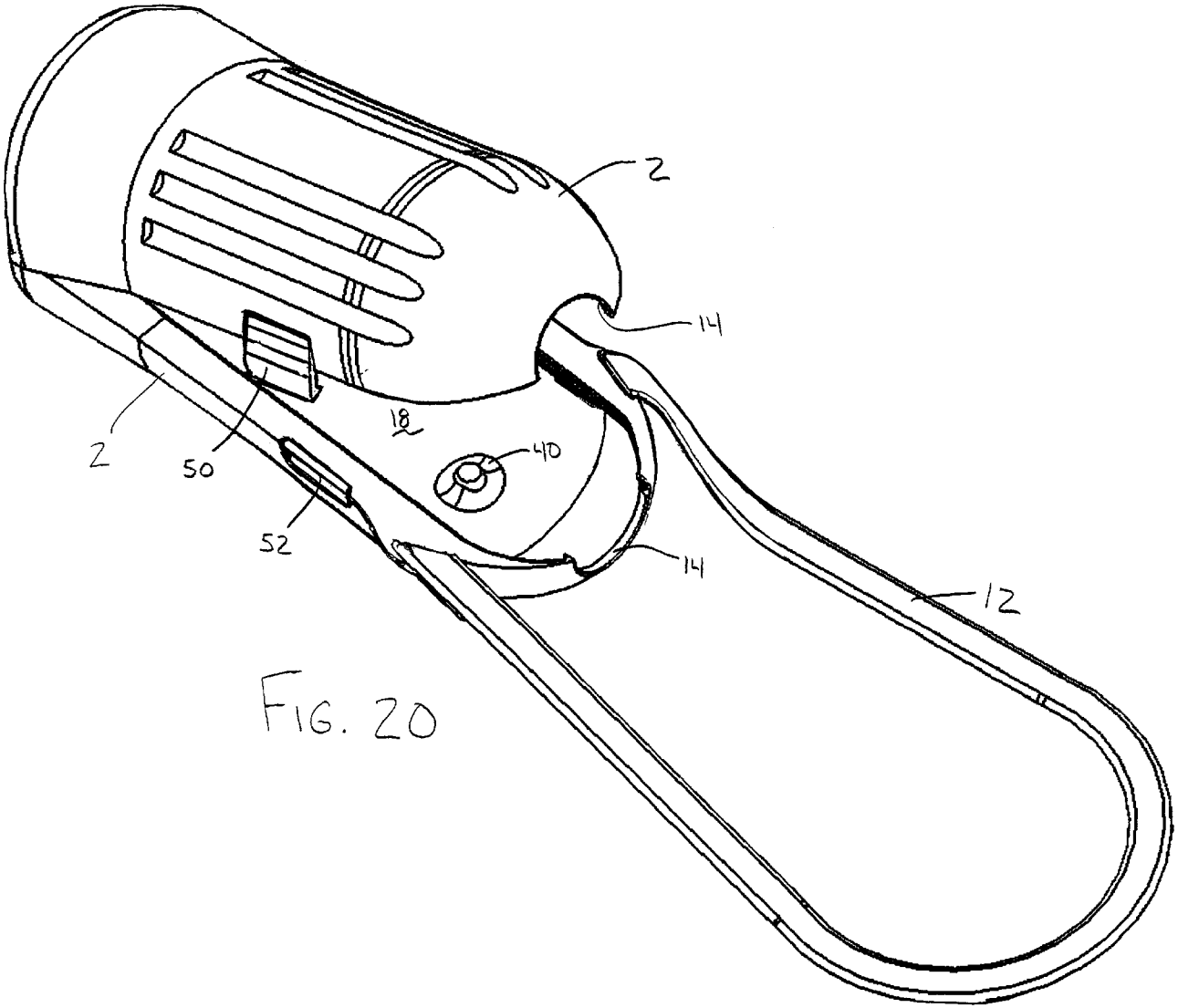
FIG. 20 is a perspective view of a beverage bottle container having a hinged bottom in accordance with another embodiment of the present invention.

With reference now to FIGS. 16–20, where like components are designated by like reference numerals, another embodiment of the present invention includes separate carrying means 12, such as a handle, strap, and the like, and fastening means 50. More particularly, the handle is molded into or otherwise attached to one of the two container portions 2 and is separate from the fastening means 50. In one embodiment in which the container includes a bottom hinged surface, shown in FIGS. 16–18, the fastening means 50 includes a pair of latches, which cooperate with a pair of latch slots 52 to hold the bottle container in a closed configuration. Alternatively, a single latch and cooperative latch slot may be employed. In an alternate embodiment in which the two container portions 2 are hinged along a side, as shown in FIGS. 19–20, the fastening means 50 includes a single latch and latch slot cooperative therewith. Alternatively, multiple latches and latch slots may be employed.

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiment, the invention is now claimed to be:

1. A beverage bottle container comprising:

a pair of rigid, mating container portions having inner surfaces for engagement with a beverage bottle;

each of said container portions including:

a bottom surface; hinge means; and a top surface which defines an aperture through which a neck of the beverage bottle protrudes; and bottle engagement means projecting from the inner surface of at least one of the container portions.

2. The beverage bottle container according to claim 1, wherein the bottle engagement means includes:

at least one conical projection.

3. The beverage bottle container according to claim 1, wherein the bottle engagement means includes a pair of conical projections disposed opposite one another on respective inner surfaces of the container portions.

4. The beverage bottle container according to claim 1, wherein the bottle engagement means include:

a pair of spherical projections disposed opposite one another on respective inner surfaces of the container portions.

5. The beverage bottle container according to claim 1, wherein the bottle engagement means include:

a pair of annular projections disposed opposite one another on respective inner surfaces of the container portions.

6. The beverage bottle container according to claim 5, wherein the annular projections are interrupted.

7. The beverage bottle container according to claim 1, wherein the bottle engagement means include:

at least one irregularly shaped projection disposed on the inner surface of at least one of the container portions.

8. The beverage bottle container according to claim 1, further comprising:

fastening means for holding the container portions in a closed position.

9. The beverage bottle container according to claim 8, further comprising:

a carrying handle operatively connected to one of (i) the fastening means and (ii) the top surface of one of the container portions.

10. A beverage bottle container comprising:

a pair of rigid, double-walled mating container portions having inner surfaces for engagement with a beverage bottle;

each of said container portions including:

a bottom surface having (i) a first bottom support member extending along a first direction perpendicular to a longitudinal axis, and (ii) a second bottom support member extending along a second direction perpendicular to the first direction;

hinge means disposed above and adjacent to the bottom surface; and a top surface which defines (i) a bottle neck receiving passageway, and (ii) a pair of strap posts disposed below the bottle neck receiving passageway, said strap posts extending along the first direction perpendicular to the longitudinal axis; and carrying and fastening means operatively connected to the strap posts for holding the container portions in a closed position.

11. The beverage bottle container according to claim 10, wherein the inner surface of at least one of the container portions includes:

beverage bottle engagement means.

12. The beverage bottle container according to claim 11, wherein the hinge means include:

cooperative molded-in hinges and mating slots disposed above and adjacent the bottom surface.

13. The beverage bottle container according to claim 11, wherein the beverage bottle engagement means include:

at least one conical projection extending inward from the inner surface of at least one of the container portions.

14. The beverage bottle container according to claim 11, wherein the beverage bottle engagement means include:

at least one spherical projection extending inward from the inner surface of at least one of the container portions.

15. The beverage bottle container according to claim 11, wherein the beverage bottle engagement means include:

at least one annular projection extending inward from the inner surface of at least one of the container portions.

16. The beverage bottle container according to claim 11, wherein the beverage bottle engagement means include:

at least one irregularly shaped projection extending inward from the inner surface of at least one of the container portions.

17. The beverage bottle container according to claim 11, wherein the container portions include cooperative sealing means for sealing the inner surfaces, thereby creating an insulated chamber.

18. The beverage bottle container according to claim 17, wherein the cooperative sealing means include:

a seal around a perimeter of the bottle neck receiving passageway; and a seal around a perimeter of at least one of the inner surfaces.

19. The beverage bottle container according to claim 14, further including:

an insulating material disposed between the double walls of the container portions.

20. The beverage bottle container according to claim 14, further including:

a freezable coolant disposed between the double walls of the container portions.

21. The beverage bottle container according to claim 14, wherein the double walls of the container portions are made of polyethylene.

22. A bottle carrier comprising:

a pair of double-walled mating portions joined to form a substantially cylindrical, thermally insulated inner chamber;

a support base extending from the bottom of the inner chamber for supporting the carrier in an upright position;

hinge means molded into one of (i) the support base, and (ii) a side portion of at least one of the mating portions;

a latching assembly including a latch and receiving slot; and a carrying handle operatively connected to a top surface of at least one of the mating portions.

23. The bottle carrier according to claim 22 further comprising:

bottle engagement means extending inward from at least a portion of an inner surface which defines the inner chamber.

24. The bottle carrier according to claim 23, wherein the bottle engagement means include:

a pair of internal projections, said internal projections being one of (i) conical, (ii) spherical, and (iii) annular in shape.

* * * * *